United States Patent [19]

Paliwoda

[11] Patent Number: 5,001,879

[45] Date of Patent: Mar. 26, 1991

[54] BUILDING INSULATION

[75] Inventor: Kenneth J. Paliwoda, Strongsville, Ohio

[73] Assignee: Therm-All, Inc., North Olmsted, Ohio

[21] Appl. No.: 472,033

[22] Filed: Jan. 30, 1990

[51] Int. Cl.[5] ..... E04C 1/00

[52] U.S. Cl. ..... 52/309.8; 52/404; 52/525

[58] Field of Search ..... 52/309.8, 521, 525, 52/404, 409, 539, 540, 523

[56] References Cited

U.S. PATENT DOCUMENTS 3,121,649 2/1964 Oliver .
3,455,076 7/1969 Clarvoe ..... 52/309.8 X
3,505,770 4/1970 Bennett ..... 52/540 X
3,919,443 11/1975 Porter ..... 52/309.8 X
3,979,537 9/1976 Troyer .
4,453,358 6/1984 Gruber et al. ..... 52/309.8

*Primary Examiner*—David A. Scherbel
*Assistant Examiner*—Crieghton Smith
*Attorney, Agent, or Firm*—Tarolli, Sundheim & Covell

[57] ABSTRACT

A piece of insulation has a body of insulating material and a vapor barrier sheet adhered to the body of insulating material. The vapor barrier sheet has a first tab extending beyond the body of insulating material. The vapor barrier sheet has a portion non-adhered to and overlapping the body of insulating material to form a second tab. A location is defined between the second tab of the vapor barrier sheet and the body of insulating material for receiving a first tab of another piece of insulation.

6 Claims, 2 Drawing Sheets

BUILDING INSULATION

TECHNICAL FIELD

The present invention relates to insulation for buildings and to a method for installing insulation in buildings.

BACKGROUND ART

Building insulation is made up of many pieces of insulation aligned in a side-by-side relationship. Typically, each piece of insulation has a body of insulating material and a vapor barrier sheet to which the body of insulating material is attached. The vapor barrier sheet projects beyond the body of insulating material. When a piece of insulation is installed, its vapor barrier sheet is secured to a vapor barrier sheet of an adjacent piece of insulation. Staples are typically used to secure the vapor barrier sheets which project beyond the body of insulating material together. Thus, a joint is formed between the two pieces of insulation after the two vapor barrier sheets are secured together.

A vapor barrier sheet is to keep water vapor in the air out of the body of insulating material, and to provide an aesthetic appearance for the insulation. The vapor barrier sheet covers the body of insulating material and blocks water vapor in the air from entering into the body of insulating material and condensing thereon. Water vapor in the air has a tendency to infiltrate through the joint formed between the two pieces of insulation. This infiltration carries water vapor in the air into the two bodies of insulating material and can create a condensation problem. Such condensation is undesirable because it wets the insulating material causing it to lose its insulating ability.

When staples are used to secure vapor barrier sheets together, care must be exercised in installing the pieces of insulation so that water vapor flow through the joints is kept at a minimum. Additionally, the staples are located between the ends of abutting pieces of insulation, which makes installation cumbersome. Due to the cumbersome nature of the installation and by having to exercise care in installing pieces of insulation, the time and labor required to install the insulation may be substantial. Thus, the cost of installing insulation is relatively high.

The need for staples is eliminated in some insulation by using adhesive to secure vapor barrier sheets together. One example of insulation which uses adhesive and does not require staples is disclosed in U.S Pat. No. 3,121,649. U.S. Pat. No. 3,121,649 discloses a roll of insulation including a vapor barrier disposed along one side of a body of insulation. The vapor barrier extends beyond an edge along the one side of the body of insulation to form a lipped portion of the vapor barrier. A pressure sensitive adhesive strip is bonded to the lipped portion and is covered for shipment and storage by a strip of separation paper. Another pressure sensitive adhesive strip is bonded to a non-lipped portion of the vapor barrier. The non-lipped portion of the vapor barrier is located near another edge along the one side of the body of insulation. The edge along the one side of the body of insulation associated with the non lipped portion of the vapor barrier is located opposite the edge along the one side of the body of insulation associated with the lipped portion of the vapor barrier. This other pressure sensitive adhesive strip is also covered by a strip of separation paper.

To install rolls of insulation, the lipped portion of the vapor barrier of a first roll of insulation is butted against the non-lipped portion of the vapor barrier of a second roll of insulation. The adhesive strip and its separation paper on the lipped portion of the first roll of insulation overlies the adhesive strip and its separation paper on the non-lipped portion of the second roll of insulation. The separation papers on the two rolls of insulation are removed to allow the two adhesive strips to come in contact with each other. A bond between the two adhesive strips is thereby established.

Also, in U.S. Pat. No. 3,121,649, a lipped portion of the vapor barrier projects beyond opposite sides of the body of insulation. Adhesive and separation papers are bonded to each lipped portion. To install rolls of insulation, a lipped portion of one roll of insulation and a lipped portion of another roll of insulation are folded up between the two bodies of insulation. The separation paper on each of the two bodies of insulation is removed to allow the adhesive strip on the lipped portion of one roll of insulation to come in contact with the lipped portion of the other roll of insulation.

A disadvantage in using adhesive strips to secure two bodies of insulation together is that once adjacent adhesive strips come in contact with each other, an installer loses flexibility to make alignment corrections. Another disadvantage is the additional time required of an installer to first remove the separation papers and then bring the adhesive strips in contact with each other. Still another disadvantage is the additional cost associated with producing a body of insulation with an adhesive strip and a strip of separation paper.

Another example of insulation which uses adhesive and does not require staples is disclosed in U.S Pat. No. 3,979,537. U.S. Pat. No. 3,979,537 discloses a roll of insulation in which a vapor barrier extends along one side of a blanket of insulating material. The vapor barrier extends beyond an edge of the blanket to form a tab. The tab is reinforced by either a taping or a folding back of a portion of the tab. To install rolls of insulation, the tabbed edge of a first roll of insulation is butted against a non-tabbed edge of a second roll of insulation. The tab of the first roll overlies a portion of the second roll. A disadvantage in using tape to reinforce tabs is the additional cost associated with producing a blanket of insulating material having tabs reinforced with tape.

SUMMARY OF THE INVENTION

The present invention is directed to pieces of insulation and to a method for installing the pieces of insulation in buildings. A piece of insulation includes a body of insulating material and a vapor barrier sheet adhered to the body of insulating material. The vapor barrier sheet has a first tab portion extending beyond the body of insulating material. The vapor barrier sheet has a second tab portion non-adhered to and overlapping the body of insulating material. The second tab portion extends in a direction away from the first tab portion. The second tab portion does not extend beyond the body of insulating material. A first tab portion of another piece of insulation may be positioned between the second tab portion of the vapor barrier sheet and the body of insulating material.

To install the insulation, one piece of insulation is laid alongside the other piece of insulation so that the first tab portion of the one piece of insulation butts against a portion of the body of insulating material of the other piece of insulation. A portion of the body of insulating material of the other piece of insulation is moved back from an initial position to allow the first tab portion of the one piece of insulation to be positioned in a space defined between the second tab portion of the vapor barrier sheet and the body of insulating material of the other piece of insulation. Installation is complete when the moved back portion of the body of insulating material of the other piece of insulation returns to its initial position against the first tab portion of the one piece of insulation.

BRIEF DESCRIPTION OF THE DRAWINGS

The foregoing and other features and advantages of the present invention will become apparent to one skilled in the art to which the present invention relates from reading the following description of a preferred embodiment in conjunction with the accompanying drawings, wherein.

DETAILED DESCRIPTION OF A PREFERRED EMBODIMENT

Figure 1:
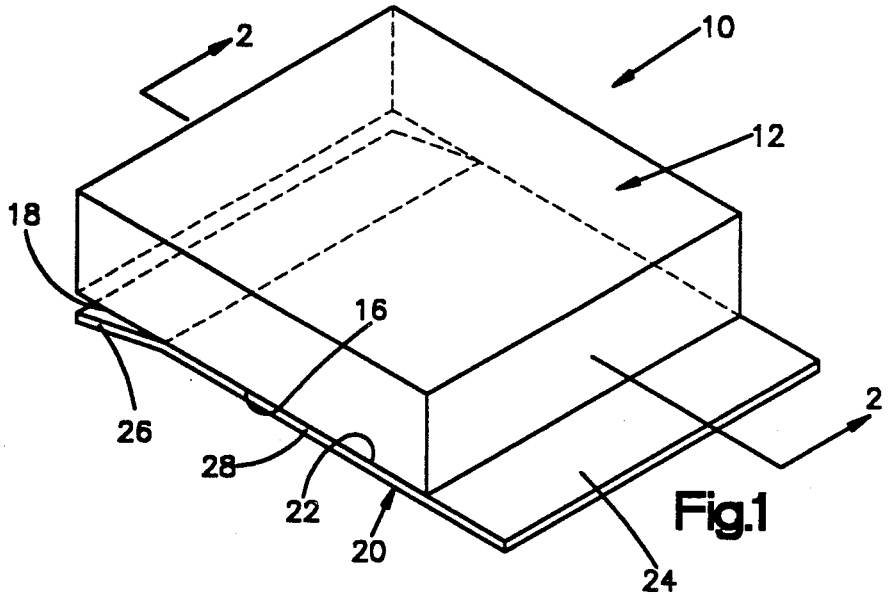
FIG. 1 is a perspective view of a piece of insulation constructed in accordance with the present invention.
Figure 2:
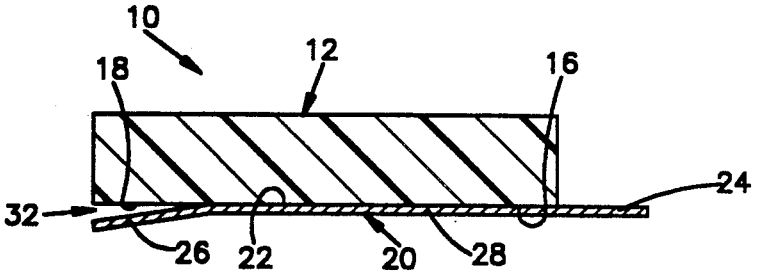
FIG. 2 is a view of the piece of insulation of FIG. 1 taken approximately along the line 2—2 of FIG. 1.

The present invention is directed to insulation and to a method for installing insulation in buildings. The specific construction and use of the insulation of the present invention may vary. As an example, the present invention is illustrated in FIGS. 1 and 2 as a piece of insulation 10 for use in insulating a building.

The piece of insulation 10 includes a body of insulating material 12 such as fiberglass having the general shape of a rectangular block. The fiberglass 12 includes a first surface portion 16 and a second surface portion 18. The piece of insulation 10 further includes a vapor barrier sheet 20 having a major side surface 22 in facing relationship to the first and second surface portions 16, 18 of the fiberglass 12. The vapor barrier sheet 20 has first and second end portions 24, 26 and a central portion 28 located between the first and second end portions 24, 26. The vapor barrier sheet 20 is relatively thin with respect to the body of insulating material. For purposes of explanation, the thickness of the vapor barrier sheet 20 is shown exaggerated in the drawings. Preferably, the vapor barrier sheet 20 is constructed of a finished material with a backing disposed on at least a portion of the vapor barrier sheet 20. The backing faces the body of insulating material 12.

The central portion 28 of the vapor barrier sheet 20 is laminated with a suitable adhesive such as glue to the first surface portion 16 of the fiberglass 12. The first end portion 24 of the vapor barrier sheet 20 extends beyond the fiberglass 12 to form a first tab of the vapor barrier sheet 20. The second end portion 26 of the vapor barrier sheet 20 is in facing relationship with and overlaps the second surface portion 18 of the fiberglass 12 to form a second tab of the vapor barrier sheet 20. The second tab 26 extends in a direction away from the first tab 24. The second tab 26 does not extend beyond the fiberglass 12 and is non-adhered to the fiberglass 12.

A location 32 is defined between the second end portion 26 of the vapor barrier sheet 20 and the second surface portion 18 of the fiberglass 12. A first tab portion of another piece of insulating may be received in the location 32 defined between the vapor barrier sheet 20 and the body of insulating material 12. As shown in FIGS. 1 and 2 only, the second tab 26 is bent back away from the body of insulating material 12 to better show the location 32 defined between the vapor barrier sheet 20 and the body of insulating material 12. Although the second tab 26 can be bent back away from the body of insulating material, as shown in FIGS. 1 and 2, it will be understood that the vapor barrier sheet 20 has sufficient stiffness and rigidity to be self-supporting. The vapor barrier sheet 20 is self-supporting in that neither the first tab 24 nor the second tab 26 droops toward the ground due to the force of gravity when the piece of insulation 10 is installed. Examples of vapor barrier sheets which can be used include MB 2001 and MB 2003, both manufactured by the Compac Corporation, Netcong, N.J.

Figure 3:
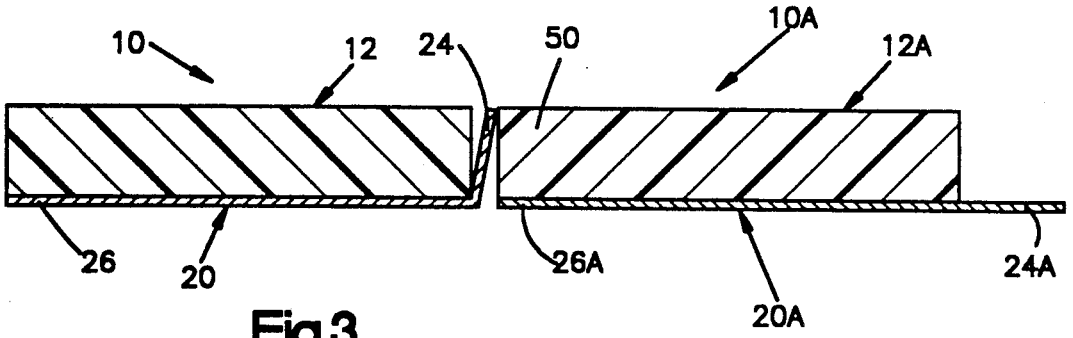
FIG. 3 is a view of the piece of insulation of FIG. 1 laying adjacent to another piece of insulation, illustrating parts in an initial position.
Figure 4:
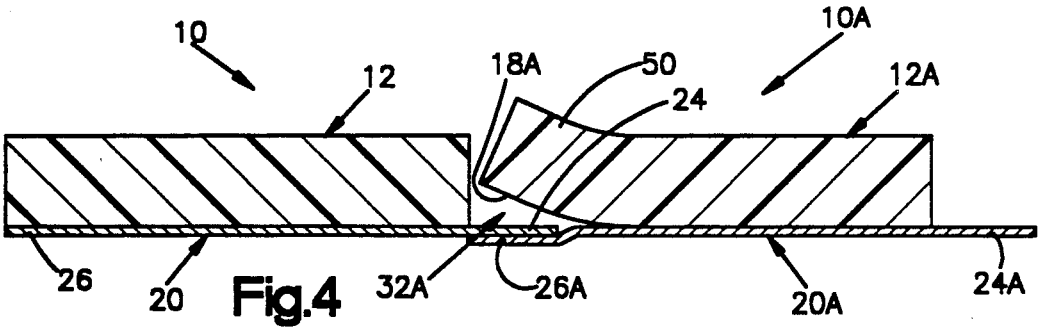
FIG. 4 is a view similar to FIG. 3, illustrating parts in an intermediate position.
Figure 5:
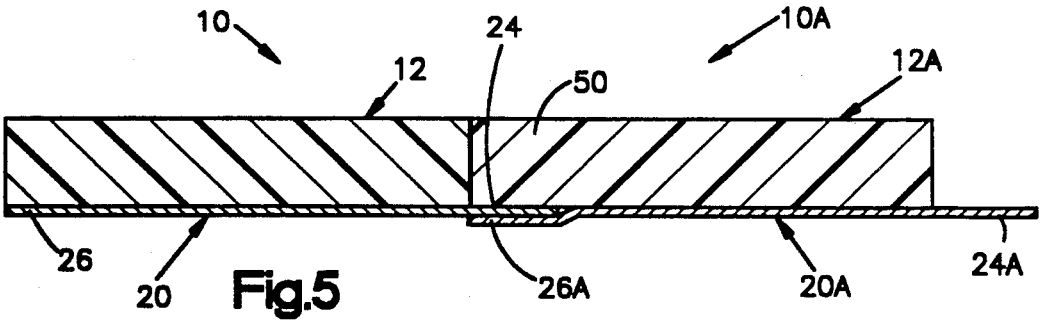
FIG. 5 is a view similar to FIG. 3, illustrating parts in a completely installed position.

With reference to FIGS. 3 to 5, a method for installing the piece of insulation 10 and another piece of insulation 10A is described hereinbelow Since the piece of insulation 10A illustrated in FIGS. 3 to 5 is the same as the piece of insulation 10 illustrated in FIGS. 1 and 2, similar numerals are utilized to designate the same components, the suffix letter "A" being added to the numerals associated with the piece of insulation 10A of FIGS. 3 to 5. To install the two pieces of insulation 10, 10A , the piece of insulation 10 is placed alongside the piece of insulation 10A as shown in FIG. 3. When the piece of insulation 10 is placed alongside the piece of insulation 10A, the first tab 24 of the piece of insulation 10 may be abutted against a portion of the fiberglass 12A of the piece of insulation 10A and extends in between the two pieces of insulation 10, 10A as shown in FIG. 3.

A portion of the fiberglass 12A of the piece of insulation 10A, designated with reference numeral 50, is moved back from an initial position as shown in FIG. 3 to an intermediate position as shown in FIG. 4 to allow the first tab 24 of the piece of insulation 10 to fall onto the second tab 26A of the piece of insulation 10A. After the tab 24 of the piece of insulation 10 falls onto the second tab 26A of the piece of insulation 10A, the moved back portion 50 of the piece of insulation 10A returns to its initial position against the first tab 24 of the piece of insulation 10, as shown in FIG. 5. The installation of the two pieces of insulation 10, 10A is complete after the moved back portion 50 of the piece of insulation 10A returns to its initial position against the first tab 24 of the piece of insulation 10. Thus, after the two pieces of insulation 10, 10A are installed, the first tab 24 of the piece of insulation 10 extends into the location 32A and is sandwiched between the second surface portion 18A and the second tab 26A of the piece of insulation 10A.

Figure 6:
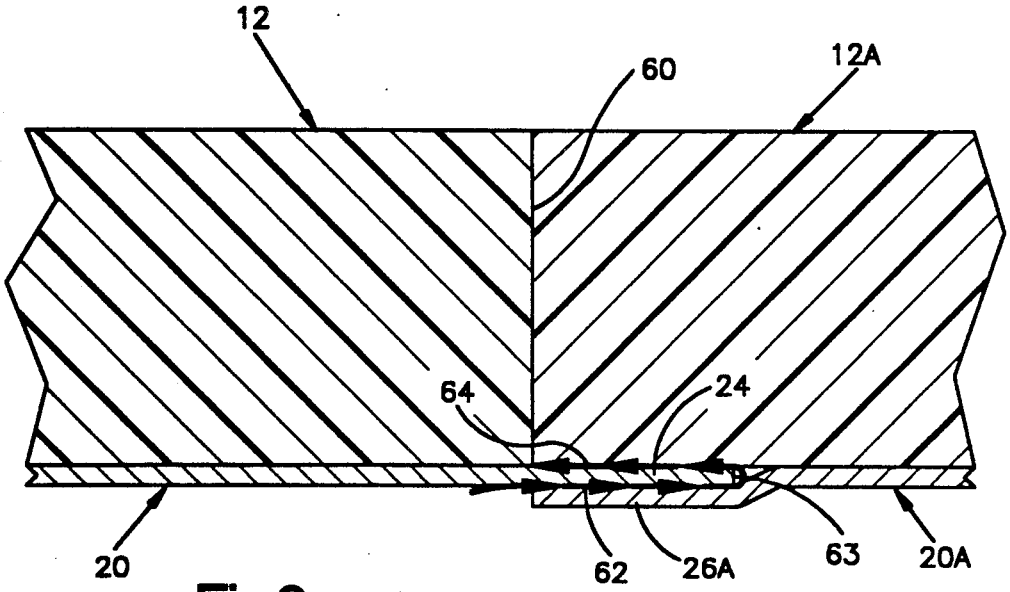
FIG. 6 is an enlarged view of a portion of FIG. 5.

Referring to FIG. 6, the extension of the first tab 24 of the piece of insulation 10 into the location 32A of the piece of insulation 10A provides a double thickness of vapor barrier sheets 20, 20A at the joint 60 formed between the two pieces of insulation 10, 10A. By providing a double thickness of the vapor barrier sheets 20, 20A, a torturous path is provided for the air containing water vapor to flow. The flow of air through this torturous path is illustrated in FIG. 6 with the heavy shaded arrows.

Initially, the air flows into a seam 62 defined between the first tab 24 of the piece of insulation 10 and the second tab 26A of the piece of insulation 10A. Due to the stiffness and rigidity of the vapor barrier sheets 20, 20A, an area of contact is established at the seam 62 between the first tab 24 of the piece of insulation 10 and the second tab 26A of the piece of insulation 10A. The contacting force at the seam 62 is sufficient to prevent any substantial amount of airflow through the seam 62. The water vapor in the air then flows around an end edge 63 of the first tab 24 of the piece of insulation 10 and into a seam 64 defined between the first tab 24 of the piece of insulation 10 and the fiberglass 12A of the piece of insulation 10A. Due to the stiffness and rigidity of the vapor barrier sheets 20, 20A, another area of contact is established at the seam 64 between the first tab 24 of the piece of insulation 10 and the fiberglass 12A of the piece of insulation 10A. The contacting force at the seam 64 is sufficient to prevent any substantial amount of airflow through the seam 64. By having the areas of contact at the seams 62, 64 and the torturous path for airflow therethrough, an effective seal is provided which prevents any substantial amount of airflow into the joint 60 between the two pieces of insulation 10, 10A.

The result is an improved vapor barrier, better moisture sealing, and therefore better insulating value. The insertion of the first tab 24 of the piece of insulation 10 into the location 32A of the piece of insulation 10A eliminates the need for reinforcing the first tab 24 and the need for separation paper and the adhesive applied thereto. Thus, the double thickness of the vapor barrier sheets 20, 20A provides at least the same insulating effect as a tab reinforced with tape, but at no additional cost. Also, not only are improved insulating characteristics obtained, but an improved finished appearance of a continuous vapor barrier is provided.

By using the pieces of insulation 10, 10A and installing the same in accordance with the present invention, cost savings is achieved in a number of ways. Since no adhesive is required in the location 32A between the second surface portion 18A of the fiberglass 12A and the second tab 26A of the vapor barrier sheet 20A, the overall consumption of adhesive is less than otherwise would be if adhesive was required. The actual amount of adhesive used may be reduced, for example, by about ten percent. Also, since no staples are needed to install the two pieces of insulation 10, 10A, there is less material needed and the need for staple guns is eliminated.

Further, the time required for installation is substantially less because stapling or removing of strips of separation paper is no longer required. Another advantage provided in using pieces of insulation 10, 10A constructed in accordance with the present invention is that an installer has flexibility to easily make alignment corrections while installing the pieces of insulation. This flexibility is provided because no staples or adhesive are used to install the pieces of insulation 10, 10A.

Although the pieces of insulation 10, 10A described herein do not require staples or adhesive to install, it is conceivable that staples or adhesive could be used if an installer chooses to do so. Further, it is contemplated that the pieces of insulation 10, 10A may be installed by adding an adhesive tape, mastic, or by mechanically sealing together the first tab 24 of the piece of insulation 10 and the second tab 26 of the piece of insulation 10A.

This invention has been described above with reference to a preferred embodiment. Modifications and alterations may become apparent to one skilled in the art upon reading and understanding this specification. It is intended to include all such modifications and alterations within the scope of the appending claims.

Having described a specific preferred embodiment of the invention, the following is claimed:

1. A piece of insulation comprising:
a body of insulating material;
a vapor barrier sheet adhered to said body of insulating material;
said vapor barrier sheet having a first tab portion extending beyond said body of insulating material; and
said vapor barrier sheet having a portion non-adhered to and overlapping said body of insulating material to form a second tab portion, said second tab portion of said vapor barrier sheet and said body of insulating material defining a location therebetween for receiving a first tab of another piece of insulation.

2. A piece of insulation of claim 1 wherein said body of insulating material is made of fiberglass.

3. A piece of insulation of claim 1 wherein said vapor barrier sheet is constructed of a finished material with a backing disposed on at least a portion of said vapor barrier sheet, said backing facing said body of insulating material.

4. A piece of insulation comprising:
a body of insulating material including a major side surface having a first surface portion and a second surface portion located adjacent to said first surface portion;
a vapor barrier sheet including a major side surface having first and second end surface portions and a central surface portion located between said first and second end surface portions;
said central surface portion of said vapor barrier sheet being adhered to said first surface portion of said body of insulating material;
said first end surface portion of said vapor barrier sheet extending beyond said body of insulating material to form a tab; and
said second end surface portion of said vapor barrier sheet overlapping said second surface portion of said body of insulating material, said second end portion of said vapor barrier sheet and said second surface portion of said body of insulating material defining a location therebetween for receiving a tab of another piece of insulation.

5. A piece of insulation of claim 4 wherein said body of insulating material is made of fiberglass.

6. A piece of insulation of claim 4 wherein said vapor barrier sheet is constructed of a finished material with a backing disposed on at least a portion of said vapor barrier sheet, said backing facing said body of insulating material.

* * * * *